US010166604B2

(12) United States Patent
Binder et al.

(10) Patent No.: US 10,166,604 B2
(45) Date of Patent: Jan. 1, 2019

(54) COMPOSITION OF PARTICULATE MATERIALS AND PROCESS FOR OBTAINING SELF-LUBRICATING SINTERED PRODUCTS

(71) Applicants: Whirlpool S.A., San Paulo (BR); Universidade Federal de Santa Catarina (UFSC), Florianopolis (BR); Lupatech S.A., Caxias do Sul-RS (BR)

(72) Inventors: Roberto Binder, Joinville (BR); Aloisio Nelmo Klein, Florianopolis (BR); Cristiano Binder, Florianopolis (BR); Gisele Hammes, Florianopolis (BR); Moises Luiz Parucker, Joinville (BR); Waldyr Ristow Junior, Caxias do Sul (BR)

(73) Assignees: Whirlpool, S.A., Sao Paulo (BR); Universidade Federal de Santa Catarina(UFSC), Florianopolis (BR); Lupatech S.A., Caxias do Sul-Rs (BR)

( * ) Notice: Subject to any disclaimer, the term of this patent is extended or adjusted under 35 U.S.C. 154(b) by 454 days.

(21) Appl. No.: 14/959,020

(22) Filed: Dec. 4, 2015

(65) Prior Publication Data

US 2016/0184896 A1 Jun. 30, 2016

Related U.S. Application Data

(62) Division of application No. 12/998,044, filed as application No. PCT/BR2009/000292 on Sep. 9, 2009, now Pat. No. 9,243,313.

(30) Foreign Application Priority Data

Sep. 12, 2008 (BR) ..... 0803956

(51) Int. Cl.

| | |
|---|---|
| ***B22F 3/16*** | (2006.01) |
| ***B22F 7/08*** | (2006.01) |
| ***C22C 33/02*** | (2006.01) |
| ***B22F 1/00*** | (2006.01) |
| ***B22F 5/00*** | (2006.01) |
| ***B22F 9/04*** | (2006.01) |

(52) U.S. Cl.

CPC ..... *B22F 3/16* (2013.01); *B22F 1/007* (2013.01); *B22F 5/006* (2013.01); *B22F 7/08* (2013.01); *B22F 9/04* (2013.01); *C22C 33/0221* (2013.01); *C22C 33/0228* (2013.01); *B22F 2301/35* (2013.01); *B22F 2302/20* (2013.01); *B22F 2304/10* (2013.01); *B22F 2998/10* (2013.01); *Y10T 428/12014* (2015.01)

(58) Field of Classification Search

None

See application file for complete search history.

(56) References Cited

U.S. PATENT DOCUMENTS

| | | | | |
|---|---|---|---|---|
| 4,842,953 | A | 6/1989 | Perkins et al. | 428/553 |
| 5,049,450 | A | 9/1991 | Dorfman et al. | 428/570 |
| 5,196,471 | A | 3/1993 | Rangaswamy et al. | 524/406 |
| 5,252,380 | A | 10/1993 | Nakazumi | 252/62.55 |
| 5,259,860 | A * | 11/1993 | Ikenoue | C22C 32/0089 419/11 |
| 5,332,422 | A | 7/1994 | Rao | 75/252 |
| 5,338,508 | A | 8/1994 | Nitta et al. | 420/120 |
| 5,545,249 | A | 8/1996 | Tanaka | 419/14 |
| 5,937,268 | A * | 8/1999 | Ozaki | C22C 33/0228 419/12 |
| 5,951,892 | A | 9/1999 | Wolfla et al. | 219/121.69 |
| 6,228,138 | B1 * | 5/2001 | Yamanishi | C22C 33/0207 419/11 |
| 6,296,682 | B1 * | 10/2001 | Uenosono | C22C 33/0207 75/252 |
| 6,682,579 | B2 * | 1/2004 | Narasimhan | C22C 33/0228 419/14 |
| 6,887,530 | B2 | 5/2005 | Fiala et al. | 427/456 |
| 6,890,368 | B2 | 5/2005 | Braillard et al. | 75/231 |
| 2003/0219617 | A1 | 11/2003 | Ozaki et al. | 428/570 |
| 2004/0023056 | A1 | 2/2004 | Braillard et al. | 428/570 |
| 2007/0227299 | A1 | 10/2007 | Marchiando et al. | 75/244 |
| 2009/0054275 | A1 | 2/2009 | Billiet | 508/100 |

FOREIGN PATENT DOCUMENTS

| | | |
|---|---|---|
| EP | 614 026 A1 | 9/1994 |
| EP | 1 067 205 A1 | 1/2001 |
| JP | 58-133346 | 8/1983 |
| JP | 63-186851 | 8/1988 |
| JP | 1-182622 | 7/1989 |
| JP | 1-259103 | 10/1989 |
| JP | 3-162502 | 7/1991 |
| JP | 11-286755 | 10/1999 |

* cited by examiner

*Primary Examiner* — Jenny R Wu

(74) *Attorney, Agent, or Firm* — Harrington & Smith

(57) ABSTRACT

The metallurgical composition comprises a main particulate metallic material, for example iron or nickel, and at least one alloy element for hardening the main metallic material, which form a structural matrix; a particulate solid lubricant, such as graphite, hexagonal boron nitride or mixture thereof; and a particulate alloy element which is capable of forming, during the sintering of the composition conformed by compaction or by injection molding, a liquid phase, agglomerating the solid lubricant in discrete particles. The composition may comprise an alloy component to stabilize the alpha-iron matrix phase, during the sintering, in order to prevent the graphite solid lubricant from being solubilized in the iron. The invention further refers to the process for obtaining a self-lubricating sintered product.

6 Claims, 5 Drawing Sheets

COMPOSITION OF PARTICULATE MATERIALS AND PROCESS FOR OBTAINING SELF-LUBRICATING SINTERED PRODUCTS

CROSS REFERENCE

This patent application is a divisional application of copending U.S. patent application Ser. No. 12/998,044, filed Apr. 11, 2011, which is a National Stage Entry of PCT/BR2009/000292, filed Sep. 9, 2009, and which claims priority to Brazil Application PI 0803956-9, filed Sep. 12, 2008, the disclosures of which are incorporated by reference herein in their entireties.

FIELD OF THE INVENTION

The present invention refers to specific techniques for obtaining, by powder metallurgy, manufacturing finished products (pieces) and semi-finished products (several articles), conformed from a metallurgical composition of particulate materials (in the form of metallic and non-metallic powders) and which are designed to be sintered, said products comprising, besides the elements constitutive of the metallic structural matrix of the product to be formed during the sintering step, a solid lubricant, in the particulate form and which is dispersed in the metallic matrix, leading to the formation of the micro-structure of a self-lubricating composite product presenting a continuous metallic matrix and which is capable of imparting, to the sintered products, a low coefficient of friction allied to high mechanical strength and high hardness of the sintered piece or product. The invention refers to said metallurgical composition for forming the self-lubricating composite product (pieces), by sintering, from said composition, as well as to the specific alternative techniques or processes for obtaining said pieces or products by powder metallurgy.

BACKGROUND OF THE INVENTION

In mechanical engineering, there is an increasing search to obtain materials for applications which require properties, such as high mechanical strength and high wear strength allied to a low coefficient of friction. Nowadays, wear and corrosion problems jointly represent losses from 2% to 5% of World GDP; about 35% of the whole mechanical energy produced in the planet is lost due to lubrication deficiency and is converted in heat by friction. Apart from the energy loss, the generated heat impairs the performance of the mechanical system due to heating. Thus, maintaining a low coefficient of friction in mechanical pieces under friction is highly important, not only for energy economy, but also to enhance the durability of said pieces and of the mechanical systems in which they operate, besides contributing to environment preservation.

The manner being used to reduce wear and friction between surfaces in relative movement is to maintain these surfaces separated, interleaving a lubricating layer therebetween. Among possible lubricating ways, the hydrodynamic (fluid lubricants) is the most used. In the hydrodynamic lubrication there is formed an oil film which separates completely the surfaces in relative movement. However, it should be pointed out that the use of fluid lubricants is usually problematic, as in applications at very high or very low temperatures, in applications in which the fluid lubricant may chemically react and when the fluid lubricant may act as a contaminant. Besides, in situations of limit lubrication resulting from cycle stops, or in situations in which it is impossible to form a continuous oil film, there occurs contact between the pieces, consequently causing wear to the latter.

The dry lubrication, that is, the one using solid lubricants, is an alternative to the traditional lubrication, since it acts by the presence of a lubricating layer, which prevents the contact between the component surfaces but without presenting rupture of the formed layer.

The solid lubricants have been well accepted in problematic lubrication areas. They can be used at extreme temperatures, under high-load conditions and in a chemically reactive environment, where conventional lubricants cannot be used. Moreover, dry lubrication (solid lubricants) is an environmentally cleaner alternative.

The solid lubricant may be applied to the components of a tribological pair, in the form of films (or layers) that are deposited or generated on the surface of the components or incorporated to the volume of the material of said components, in the form of second-phase particles. When specific films or layers are applied and in case they suffer wear, there occurs the metal-metal contact and the consequent and rapid wear of the unprotected confronting surfaces and of the relatively movable components. In these solutions in which films or layers are applied, it should be further considered the difficulty in replacing the lubricant, as well as the oxidation and degradation of the latter.

Thus, a more adequate solution which allows increasing the lifetime of the material, that is, of the components, is to incorporate the solid lubricant into the volume of the material constitutive of the component, so as to form the structure of the component in a composite material of low coefficient of friction. This is possible through the technology of processing materials from powders, that is, by the conformation of a powder mixture by compaction, including pressing, rolling, extrusion and others, or also by injection molding, followed by sintering, in order to obtain a continuous composite material, usually already in the final geometry and dimensions (finished product) or in geometry and dimensions close to the final ones (semi-finished product).

Self-lubricating mechanical components (powder metallurgy products) presenting low coefficient of friction, such as sintered self-lubricating bushings, produced by powder metallurgy from composite materials and comprising a particulate precursor which forms the structural matrix of the piece, and a particulate solid lubricant to be incorporated into the structural matrix of the piece, have been used in diverse household appliances and small equipment, such as: printers, electric shavers, drills, blenders, and the like. Most of the already well-known prior art solutions for the structural matrix use bronze, copper, silver, and pure iron. There are used as solid lubricants: molybdenum disulfide ($MoS_2$), silver (Ag), polytetrafluoroethylene (PTFE) and molybdenum diselenide ($MoSe_2$). This type of self-lubricating bushing, mainly with bronze and copper matrix containing, as solid lubricant particles, graphite powder, selenium and molybdenum disulfide and low melting point metals, has been produced and used for decades in several engineering applications.

However, these pieces do not present high mechanical strength, as a function of its high volumetric content (from 25% to 40%) of solid lubricant particles, which results in a low degree of continuity of the matrix phase, which is the micro-structural element responsible for the mechanical strength of the piece. This high content of solid lubricant has been considered necessary for obtaining a low coefficient of friction in a situation in which both the mechanical properties of the metallic matrix (strength and hardness) and the micro-structural parameters, such as the size of the solid lubricant particles dispersed in the matrix and the average free path between these particles in the formed composite material, were not optimized. The high volumetric percentage of solid lubricant, which has an intrinsic low strength to shearing, does not contribute to the mechanical strength of the metallic matrix.

Moreover, the low hardness of the metallic matrix allows a gradual obstruction of the solid lubricant particles to occur on the contact surface of the sintered material or product. Thus, in order to maintain a sufficiently low coefficient of friction, there has been traditionally used a high volumetric percentage of solid lubricant in the composition of dry self-lubricating composite materials.

A partially differentiated and more developed scenario, as compared with that previously described, is disclosed in U.S. Pat. No. 6,890,368 A, which proposes a self-lubricating composite material to be used at temperatures in the range between 300° C. and 600° C., with a sufficient traction resistance ($\sigma_t \geq 400$ MPa) and a coefficient of friction lower than 0.3. This document presents a solution for obtaining pieces or products of low coefficient of friction, sintered from a mixture of particulate material which forms a metallic structural matrix and including, as solid lubricant particles in its volume, mainly hexagonal boron nitride, graphite or a mixture thereof, and states that said material is adequate to be used at temperatures in the range between 300° C. and 600° C., with a sufficient traction resistance ($\sigma_t \geq 400$ MPa) and a coefficient of friction smaller than 0.3.

Nevertheless, pieces or products obtained from the consolidation of a powder mixture simultaneously presenting the structural matrix powders and the solid-lubricant powders, such as for example, hexagonal boron nitride and graphite, have low mechanical strength and structural fragility after sintering.

The deficiency cited above results from the inadequate dispersion, by shearing, of the solid lubricant 20 phase between the powder particles of the structural matrix 10, from the condition illustrated in FIG. 1A of the enclosed drawings, to the condition illustrated in FIG. 1B, during the steps of mixing and conforming (densification) the pieces or products to be produced. The solid lubricant 20 spreads, by shearing, between the particles of the structural matrix 10 phase, and tends to surround said particles during the mixing and conforming steps, such as by compaction, by powder pressing, powder rolling, powder extrusion, as well as by powder injection molding, which steps submit said solid lubricant to stresses which surpass its low shearing stress, as schematically illustrated in FIG. 1B of the enclosed drawings.

On the other hand, the presence of the solid-lubricant layer between the particles (of the powder) of the structural matrix, in the case of a solid lubricant that is soluble in the matrix, does not impair the formation of sintering necks between the particles of the metallic structural matrix of the composite. However, in this case, the solid lubricant, by being dissolved during the sintering of the piece, loses its lubricating function, since the solid lubricant phase disappears by dissolution in the matrix. In the case of a solid lubricant that is insoluble in the structural matrix, such as the hexagonal boron nitride, the layer 21 formed by shearing (see FIG. 1B) impairs the formation of metallic contacts between these particles which form the structural matrix 10 of the composite during the sintering; this contributes to a reduction of the degree of continuity of the structural matrix 10 phase of the composite material, structurally fragilizing the material and the obtained products.

Due to the limitations mentioned above, a technical solution becomes necessary both to prevent the solubilization of the lubricants when soluble in the structural matrix and to regroup the non-soluble solid lubricant dispersed in the form of a layer 21 in the steps of mechanically homogenizing and of conforming (densification) the particulate material mixture, in discrete particles during the sintering.

A similar situation to that described above occurs upon mixing non-soluble solid lubricant particles with the structural matrix particles of the composite material, the solid lubricant 20 having a particle size much smaller than that of the particles of the material which forms the structural matrix 10 of the composite (see FIG. 2B of the enclosed drawings). In this case, the much finer particles of the solid lubricant 20 tend to form a relatively continuous layer 21 between the metallic powder particles of the structural matrix 10, even with no shearing stresses during the processing steps previous to the sintering. The almost continuous layer 21 of fine particulate material of the solid lubricant 20 impairs the sintering between the particles of the metallic structural matrix 10, structurally fragilizing the final piece. In cases of insoluble phases, a more adequate distribution is that in which the particles of the particulate material of the composite matrix and the particles of the solid lubricant to be dispersed in the matrix present a particle size with the same magnitude order (see FIG. 2A).

Since the metallic structural matrix 10 is the sole microstructural element of the composition that confers mechanical strength to the composite material to be formed, the higher the degree of continuity of the metallic matrix of said composite, the higher will be the mechanical strength of the sintered article or piece produced with the material. In order to maintain the high degree of continuity of the metallic structural matrix of the dry self-lubricating sintered composite material, it is necessary, besides a low porosity, a low volumetric percentage of the solid lubricant phase, since said solid lubricant does not contribute to the mechanical strength of the material and, consequently, does not contribute to the mechanical strength of the sintered products.

Therefore, there is a need for a technical solution, both to prevent the solubilization of the lubricants when soluble in the matrix and to regroup the solid lubricant which, by shearing, during the steps of mechanically homogenizing and conforming (densification) of the mixture, resulted in a distribution in the form of layers 21 in the volume of the material, impairing the sintering and the degree of continuity of the structural matrix 10 of the composite. The solid lubricant 20 should be dispersed in the volume of the composite material in the form of discrete particles uniformly distributed, that is, with an average free path "λ" which is regular between the particles of the metallic structural matrix 10 (see FIG. 3). This allows promoting greater lubrication efficiency and, at the same time, a higher degree of continuity of the composite matrix, guaranteeing a higher mechanical strength to the self-lubricating composite material formed during the sintering, as illustrated in FIG. 3.

The compositions prepared to generate self-lubricating composites which present, as the material to form the matrix, the metallic element iron or ferrous alloys and simultaneously have the graphite as a solid lubricant, result in a self-lubricating sintered composite material with a matrix which can be excessively hard and fragile and with a coefficient of friction above the expected and desired one, due to the solubilization of the carbon by the iron matrix.

At the high sintering temperatures (superior to 723° C.), the chemical element carbon of the graphite is solubilized in the cubic structure of centered faces of the iron (gamma iron) or of the austenitic ferrous alloy. Thus, the use of a solid lubricant containing graphite causes an undesired reaction of the carbon with the iron, during the sintering, from temperatures above 723° C., producing a piece with reduced or no self-lubricating property, since the whole or most of the carbon of the graphite ceases to operate as a solid lubricant, forming iron carbide.

Said document U.S. Pat. No. 6,890,368 presents a solution for a material provided to form a metallic matrix and in which, in order to prevent the interaction of the solid lubricant, defined by the graphite, with the particles of the ferrous structural matrix, it is provided the previous coating of the graphite particles with a metal which, during the high sintering temperatures, minimizes the possibility of interaction of the coated graphite with the ferrous structural matrix.

While the solution suggested in U.S. Pat. No. 6,890,368 solves the problem of loss of the graphite solid lubricant during sintering of the piece by coating the graphite, said coating prevents the graphite from spreading to form a layer on the work surface of the pieces when in service (when frictioned in relative movement), reducing the supply of solid lubricant and thus making the lubrication less efficient. Besides, solely coating the graphite does not solve the fragility problem of the metallic matrix when the solid lubricant contains hexagonal boron nitride, which can, by shearing, generate a film between the matrix particles during the steps of mechanical mixing in mills and conformation (densification). The fragility problem of the sintered piece, due to shearing of the solid lubricant of hexagonal boron nitride, is not discussed in said prior US document, although this document considers the compaction and pre-sintering as one of the possible techniques for molding the piece to be sintered containing said solid lubricant of low shearing stress.

Apart from the deficiencies mentioned above, said graphite coating solution has a high cost, as a function of the materials employed and of the need of previous metallization treatment of this solid lubricant.

Moreover, the matrix types, generally used until recently for manufacturing pieces or products in self-lubricating composite materials, do not present the hardness necessary to prevent the particles of the solid lubricant phase from being rapidly covered, by the matrix phase, due to plastic micro-deformation caused by the mechanical forces to which the work surface of the piece is submitted, impairing maintaining a tribolayer by the solid lubricant spreading on said work surface of the piece.

The metallic matrix of the material is required to be highly resistant to plastic deformation, in order to operate not only as a mechanical support with the necessary load capacity, but also to prevent the solid lubricant particles from being covered by plastic deformation of the structural matrix, upon operation of the pieces (when frictioned in relative movement), preventing the solid lubricant from spreading in the interface where the relative movement occurs between the pieces.

SUMMARY OF THE INVENTION

It is, therefore, an object of the present invention to provide a metallurgical composition of composite material formed by a metallic structural matrix and by a non-metallic solid lubricant and which is adequate for the manufacture, by means of conforming (densification) and sintering operations, of sintered products (finished and semi-finished), presenting a low coefficient of friction allied to high mechanical strength and high hardness.

It is likewise an object of the present invention to provide a metallurgical composition of composite material for manufacturing, by means of conforming (densification) and sintering operations, of sintered products, such as cited above and which does not require the previous treatment of the particulate solid lubricant containing carbon, that is, from the graphite, when applied to a matrix based on iron or on ferrous alloy, even if said matrix allows the dissolution of the carbon to occur at the sintering temperatures.

A further object of the present invention is to provide a composition such as cited above and which can be easily obtained at low cost.

It is a further object of the present invention to provide a process for obtaining sintered products, by means of conformation (densification) and sintering, and which avoids the need of previously preparing the particles of the composition used, in order to guarantee the continuity of the structural matrix and the desired values of coefficient of friction and mechanical strength of the obtained product.

In a first aspect of the present invention, the objects cited above are attained through a metallurgical composition of composite material for the manufacture of self-lubricating sintered composite products, previously conformed by one of the operations of compacting and injection molding said composition which comprises a mixture of: a particulate material which defines a metallic structural matrix; a particulate material which defines a solid lubricant subjected to shearing and to the formation of a layer on the particles of the material which forms the metallic structural matrix, upon the mechanical homogenization of the mixture of the components or upon the conformation (densification) of the composition of the composite material; and at least one particulate material defining a particulate alloy element (chemical element) capable of forming a liquid phase during the sintering, by reacting with the matrix of the composite material, allowing to reverse, during the sintering, the adverse distribution of the solid lubricant present in the form of a layer.

The liquid phase, which is formed by interdiffusion of the components of the particulate mixture and upon spreading over the particles of the matrix material that are present in the material being formed, penetrates between these particles and the adhered solid lubricant layer, removing said solid lubricant and provoking the agglomeration of the solid lubricant in discrete particles dispersed in the volume of the matrix material, allowing the continuity of material of the particles of the matrix phase during the sintering.

In another aspect of the present invention, it is provided a metallurgical composition of composite material, for the manufacture of sintered products from a component that is previously conformed (densified) with the composition defined above and which comprises a mixture of: a particulate material which defines a metallic structural matrix (composite matrix), and a particulate material which defines a solid lubricant subject to reaction with the particulate material of the metallic structural matrix, at the sintering temperatures of said particulate material; and at least one particulate material defining an alloy component which stabilizes the alpha phase of the material of the metallic structural matrix (composite matrix) in said sintering temperatures.

In another aspect of the present invention, the objects above are achieved through a process for obtaining a sintered product from the metallurgical composition defined above and presenting dispersion of solid lubricant particles, said process comprising the steps of: a—mixing, in predetermined quantities, the particulate materials which define the metallurgical composition and carrying out the homogenization, for example mechanically and in a mill/mixer; b—providing the conformation (densification) of the obtained mixture, imparting to said mixture the shape of the product (piece) to be sintered; and c—sintering the pre-compacted material.

When the conformation of the metallurgical composition, previous to the sintering, is carried out by extrusion or by injection molding, it is necessary to include in said composition an organic binder to provide fluidity to the composition during the conformation phase.

The self-lubricating composite material obtained with the present invention can be used for manufacturing components of high mechanical strength, that is, for manufacturing mechanical components, such as gears, pinions, crowns, forks and drivers, pistons and connecting rods for compressors, etc., and not only for dry self-lubricating bushings.

The simultaneous high mechanical and tribological performance result from the application of a series of specific requirements related to the mechanical properties of the matrix and to the micro-structural parameters designed for the material of the composition, which are the following: hardness and mechanical strength of the matrix, size and average free path between the solid lubricant particles dispersed in the matrix; degree of continuity of the matrix; volumetric percentage of solid lubricant particles dispersed in the structural matrix; and relative stability between the solid lubricant phase and the matrix.

BRIEF DESCRIPTION OF THE DRAWINGS

The invention will be described below, with reference to the enclosed drawings, given by way of example of embodiments of the invention and in which.

DESCRIPTION OF THE INVENTION

Figure 1A:
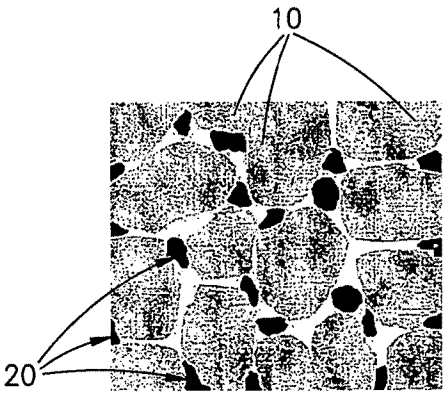
FIG. 1A PRIOR ART
FIG. 1A schematically represents a portion of the micro-structure of the prior art composition of particulate material, comprising a structural matrix and a solid lubricant containing hexagonal boron nitride and/or graphite, before submitted to the operations of mechanically homogenizing the mixture of the particulate materials and of conforming (densification) the piece, before sintering.
Figure 1B:
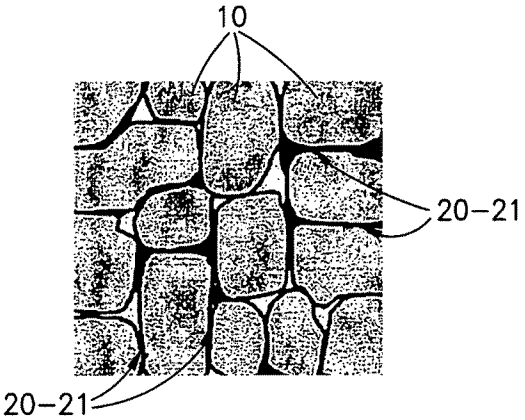
FIG. 1B PRIOR ART
FIG. 1B is similar to FIG. 1A, but illustrating the micro-structure of the same prior art composition of particulate material, after having been homogenized and conformed, with the formation of a solid lubricant layer between the particles of the structural matrix.
Figure 2A:
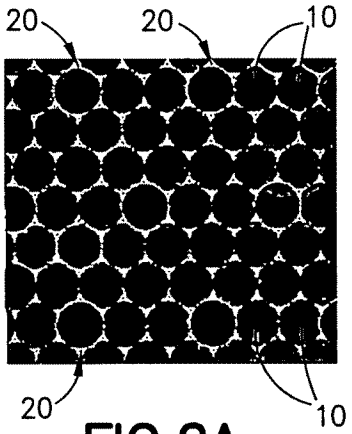
FIG. 2A PRIOR ART
FIG. 2A schematically represents a portion of the micro-structure of the composition or mixture of the particulate material of the metallic structural matrix, with the material of the particulate solid lubricant having a particle size similar (the same magnitude order) to that of the metallic structural matrix, favoring the degree of continuity of the latter.
Figure 2B:
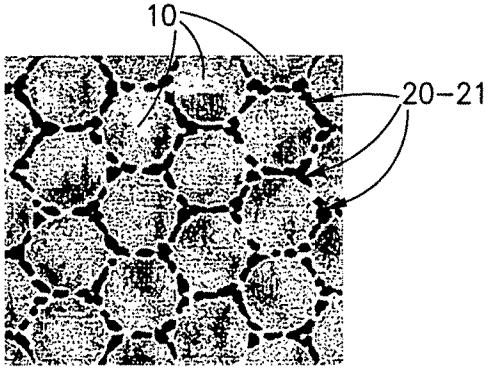
FIG. 2B PRIOR ART
FIG. 2B schematically represents a micro-structure portion of the composition of the particulate material of the structural matrix, with the solid lubricant having particle size much smaller than that of the metallic structural matrix, whereby much finer particles of the solid lubricant tend to form a relatively continuous layer between the particles of the metallic structural matrix, even in the absence of shearing stresses during the processing steps previous to sintering.

As already previously mentioned, one of the objects of the invention is to provide a metallurgical composition of particulate materials, which can be homogeneously mixed and conformed (densified) by compaction (pressing, rolling, extrusion) or by injection molding, so that it may assume a defined geometry (piece) to be submitted to a sintering operation, in order to obtain a product which presents high hardness, mechanical strength and reduced coefficient of friction in relation to the products obtained by the prior art teachings. The present metallurgical composition comprises a main particulate metallic material which is preponderant in the formation of the composition, and at least one particulate hardening alloy element, these components being responsible for the formation of a structural matrix 10 in the composite product to be sintered.

According to the invention, the main particulate metallic material is usually iron or nickel, defining a ferrous structural matrix or a nickel-based structural matrix. In the composition which uses iron as the main particulate metallic material, the particulate hardening alloy element, with the function of hardening the matrix, is defined, for example, by at least one of the elements selected from chrome, molybdenum, carbon, silicon, manganese and nickel, but it should be understood that one can use other elements which carry out the same function in the structural matrix 10. It should be noted that the invention requires the provision of an alloy hardening element which may carry out the function of hardening the structural matrix 10 to be formed, but this aspect should not be limited to the exemplified alloy elements presented herein.

Besides the components which form the structural matrix 10, the present composition comprises a non-metallic particulate solid lubricant 20 which is preferably, but not exclusively, defined by hexagonal boron nitride, graphite or also by a mixture of both in any proportion, said particulate solid lubricant 20 representing a volumetric percentage lower than or equal to about 15% the volume of the composite material to be formed, said percentage being much lower than the usual 25% to 40% of the prior art, relevantly contributing to a higher degree of continuity of the structural matrix 10 and, consequently, to a higher mechanical strength of the sintered product to be obtained.

As already mentioned in the prior art discussion and as illustrated in FIGS. 1A, 1B, 2A and 2B, due to the low shearing stress of the non-metallic particulate solid lubricant used in the formation of the composition and, posteriorly, of the sintered composite product, during the step of mixing the particulate materials of the composition and the step of conforming the composition, by compaction or by injection molding, the stresses applied to the solid lubricant 20 cause the latter to spread between the particles which form the structural matrix 10 phase, tending to surround them in a film or layer 21, impairing the formation of the sintering necks between the particles which form the metallic structural matrix 10, in case the particulate solid lubricant 20 is insoluble in the material of the structural matrix 10, as it occurs with the hexagonal boron nitride in relation to a ferrous or nickel-based structural matrix 10.

Figure 3:
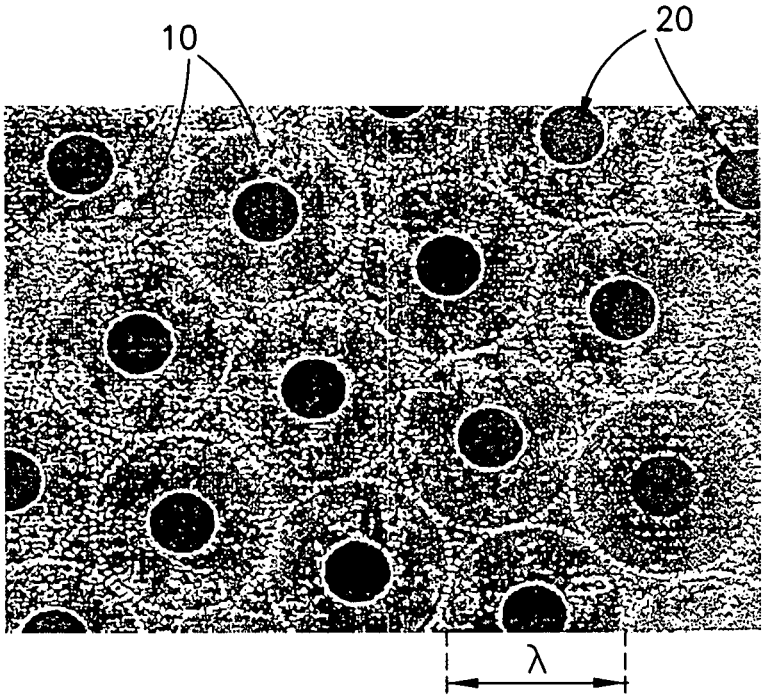
FIG. 3 schematically shows the solid lubricant in the form of discrete particles uniformly distributed, with a regular average free path "λ" therebetween, in a portion of the micro-structure of the composition of particulate material of the present invention.

In order to avoid the deficiency mentioned above, the composition of the present invention further comprises at least one particulate alloy element which is capable of forming, at the sintering temperatures of the conformed metallurgical composition, a liquid phase between the particulate material which forms the structural matrix 10 and the particulate solid lubricant 20, forcing the latter to agglomerate in discrete particles that are homogeneously dispersed in the material of the structural matrix 10, as illustrated in FIG. 3. The formation of the liquid phase and its action on the particulate solid lubricant 20 allow obtaining a high degree of continuity of the structural matrix 10 in the sintered composite product to be obtained.

When the metallurgical composition of the invention is conformed by compaction and uses a ferrous structural matrix, the main particulate metallic material of iron presents, preferably, an average particle size lying between about 10 μm to about 90 μm. On its turn, the hardening element, with the function of hardening the structural matrix 10, and the particulate alloy element, with the function of forming the liquid phase and agglomerating the particulate solid lubricant 20, during the sintering of the conformed metallurgical composition by compaction (densification), present an average particle size smaller than about 45 μm. It should be understood that the average particle size of the main particulate metallic material of iron should preferably be larger than the average particle size of the hardening element and alloy element.

The metallurgical composition with an iron-based structural matrix 10, described above and conformed by compaction or by injection molding, can be completed with the hardening element and with the alloy element when the particulate solid lubricant 20 is of the insoluble type in said ferrous structural matrix 10, for example the hexagonal boron nitride, since the particulate solid lubricant 20 does not react with the material which forms the structural matrix 10 at the sintering temperatures from about 1125° C. to about 1250° C. The reaction of the particulate solid lubricant 20 with the structural matrix 10 causes the former to partially or completely disappear in the material of the latter, impairing or even eliminating the self-lubricating characteristic of the sintered product to be obtained.

However, in case the structural matrix 10 is, for example, iron-based and the particulate solid lubricant 20 is at least partially soluble in the structural matrix 10, at the sintering temperatures of the conformed metallurgical composition by compaction or by injection molding, as it occurs, for example, with the graphite or a mixture consisting of graphite and hexagonal boron nitride, the present metallurgical composition should further comprise at least one alloy component capable of stabilizing the iron alpha phase, during the sintering of the metallurgical composition, and thus preventing the occurrence of solubilization and incorporation of the particulate solid lubricant 20 in the iron of the structural matrix 10.

According to the invention, the alloy component, which stabilizes the iron alpha phase, is defined by at least one of the elements selected from phosphorus, silicon, cobalt, chrome and molybdenum. Although these elements are considered the most adequate to separately or jointly act in stabilizing the iron alpha phase at the sintering temperatures (about 1125° C. to about 1250° C.), it should be understood that the invention resides in the concept of stabilizing the iron alpha phase and not in the fact that the alloy component(s) used are necessarily the ones exemplified herein.

Preferably, for the composition having an iron-based structural matrix 10 with a particulate solid lubricant 20, at least partially soluble in the structural matrix 10 and which is constituted, for example, by graphite or by a mixture consisting of graphite and hexagonal boron nitride, the particulate hardening alloy element, with the function of hardening the structural matrix 10, the particulate alloy element, with the function of forming the liquid phase and agglomerating the particulate solid lubricant 20, and the alloy component, with the function of stabilizing the iron alpha phase, are defined, for example, by an element selected from silicon, at contents from about 2% to about 5% by weight of the metallurgical composition, and from a mixture of silicon, manganese and carbon, at contents from about 2% to about 8% by weight of the metallurgical composition.

When the metallurgical composition of the invention is conformed by injection molding and uses a ferrous structural matrix, the main particulate metallic material of iron presents, preferably, a particle size lying between about 1 μm to about 45 μm. In the same way, the hardening element, with the function of hardening the structural matrix 10, the particulate alloy element, with the function of forming the liquid phase and agglomerating the particulate solid lubricant 20, during the sintering of the metallurgical composition conformed by injection molding and the particulate solid lubricant, present a particle size also from about 1 μm to about 45 μm.

As already mentioned, the structural matrix 10 of the metallurgical composition may be nickel-based and, in this case, any of the particulate solid lubricants 20, exemplified herein as graphite, hexagonal boron nitride or a mixture thereof in any proportion, will have the characteristic of being insoluble in the nickel structural matrix 10, at the sintering temperatures of the metallurgical composition, from about 1125° C. to about 1250° C., dispensing the use of the particulate alloy component which stabilizes the iron alpha phase.

In the metallurgical composition with a nickel structural matrix 10, the required particulate alloy element, with the function of forming the liquid phase and agglomerating the particulate solid lubricant 20, during the sintering of the metallurgical composition, is defined, for example, by at least one of the elements selected from chrome, phosphorus, silicon, iron, carbon, magnesium, cobalt and manganese.

When the metallurgical composition of the invention uses a nickel-based structural matrix 10, the main particulate metallic material of nickel presents, upon the conformation by compaction, an average particle size preferably lying between about 10 μm and about 90 μm, the hardening element, with the function of hardening the structural matrix 10, and the particulate alloy element, with the function of forming the liquid phase and agglomerating the particulate solid lubricant 20, during the sintering of the metallurgical composition conformed by compaction (densification), presenting an average particle size equal to or smaller than about 45 μm. When the conformation of the composition is made by injection molding, it is preferred that the main particulate metallic material of nickel and the hardening element, with the function of hardening the structural matrix 10, and also the particulate alloy element, with the function of forming the liquid phase, present a particle size preferably lying between about 1 μm and about 45 μm.

Considering the metallurgical composition with a nickel-based structural matrix 10, the hardening element, with the function of hardening the nickel matrix, and the particulate alloy element, with the function of forming the liquid phase and agglomerating the particulate solid lubricant 20 in discrete particles, are defined by an element selected from silicon, phosphorus and chrome, at contents from about 2% to about 5%, or from a mixture consisting of silicon, phosphorus and chrome, at contents from about 2% to about 8% by weight of the metallurgical composition.

When the conformation of the metallurgical composition, previous to the sintering, is carried out by extrusion or by injection molding, the composition should further comprise at least one organic binder selected preferably from the group consisting of paraffin and other waxes, EVA, and low melting point polymers in proportion generally ranging from about 15% to about 45% of the total volume of the metallurgical composition, upon the conformation by extrusion, and from about 40% to 45%, upon the conformation by injection molding. The organic binder is extracted from the composition after the conformation step, for example by evaporation, before the conformed product is conducted to the sintering step.

The metallurgical compositions described above are obtained by mixing, in any adequate mixer(s), predetermined quantities of the particulate materials selected for the formation of the composition and for the subsequent obtention of a self-lubricating sintered product.

The mixture of the different particulate materials is homogenized and submitted to a densification operation by compaction, that is, by pressing, rolling or extrusion, or also by injection molding, so that it can be conformed in a desired shape for the product to be obtained by sintering.

In case of conformation by injection molding, the mixture of the components containing the organic binder is homogenized at temperatures not inferior to that of melting the organic binder, the thus homogenized mixture being granulated to facilitate its handling, storage and supply to an injection machine.

After conformation of the composition, the conformed piece is submitted to a step of extracting the organic binder, generally by a thermal process.

The homogenized and conformed metallurgical composition can be then submitted to a sintering step, at temperatures from about 1125° C. to about 1250° C. Considering that both the metallurgical compositions, with an iron-based or nickel-based structural matrix 10, comprise at least one particulate alloy element with the function of forming the liquid phase, it is formed, during the sintering, said liquid phase by the particulate alloy element, and promoted the agglomeration of the particulate solid lubricant 20 in discrete particles dispersed in the volume of the structural matrix 10.

When the metallurgical composition comprises a particulate solid lubricant at least partially soluble in an iron-based structural matrix, as it occurs with the graphite and its mixture with the hexagonal boron nitride, the homogenized and conformed metallurgical composition further comprises at least one alloy component, already previously defined and which is capable of, during the step of sintering the metallurgical composition, stabilizing the iron alpha phase of the structural matrix 10, preventing the dissolution of the portion of the solid lubricant portion, defined by graphite, in the iron structural matrix.

With the metallurgical composition proposed herein, it is possible to obtain self-lubricating sintered pieces or products, from particulate materials which do not require previous treatment for the non-metallic particulate solid lubricant, said pieces or products presenting: in case of using an iron structural matrix 10, a Hardness HV ≥230, a coefficient of friction $\mu \leq 0.15$, a mechanical traction resistance $\sigma_t \geq 450$ MPa and also a dispersion of discrete particles of solid lubricant 20 with average particle size between about 10 μm and about 60 μm for the products conformed by compaction and between about 2 μm and about 20 μm for the products conformed by injection molding; and, in case of a nickel-based structural matrix 10, a Hardness HV ≥240, a coefficient of friction $\mu \leq 0.20$, a mechanical traction resistance $\sigma_t \geq 350$ MPa and also a dispersion of discrete particles of solid lubricant 20 with average particle size between about 10 μm and about 60 μm for the products conformed by compaction, and between about 2 μm and about 20 μm for the products conformed by injection molding.

FIGS. 5, 6A, 63, 60 and 7 of the enclosed drawings have the purpose of exemplifying different possibilities of conforming the present metallurgical composition, by compacting a certain predetermined quantity of the metallurgical composition to any desired shape, which can be that of the self-lubricating sintered final piece or product desired to be obtained, or a shape close to that desired final one.

However, in a large number of applications, the self-lubricating characteristic is necessary only in one or more surface regions of a mechanical component or piece, to be submitted to a friction contact with other relatively movable element.

Figure 5:
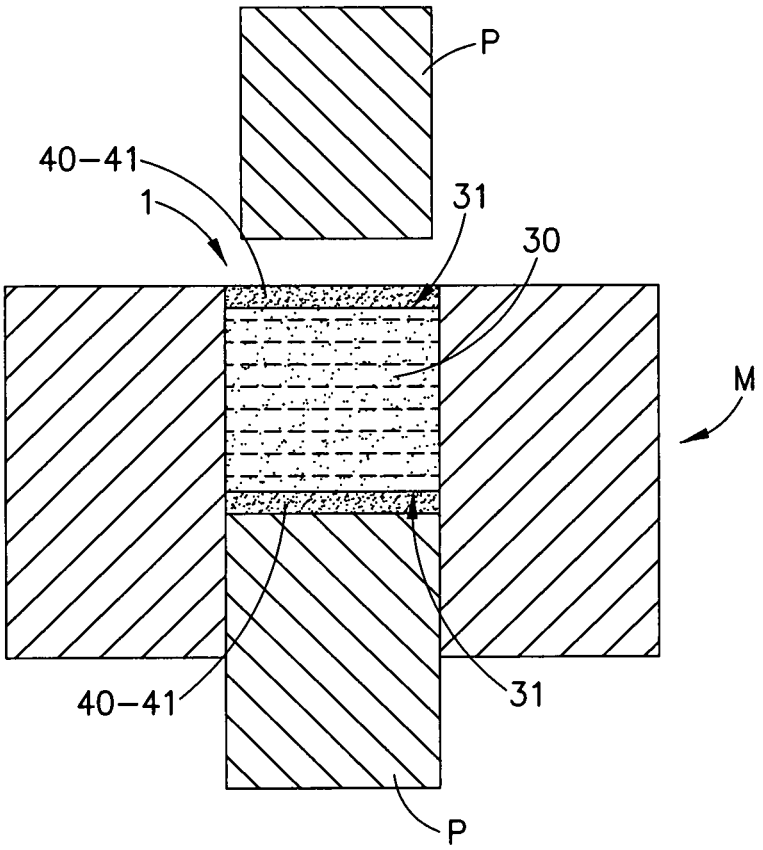
FIG. 5 schematically represents in a simplified diagram, an example of compaction in the formation of a piece or product to be posteriorly sintered, said compaction being made so as to provide a self-lubricating layer in two opposite faces of the product to be sintered.

Thus, the desired self-lubricating product can be constituted, as illustrated in FIG. 5, by a structural substrate 30 preferably conformed in a particulate material and receiving, in one or two opposite faces 31, a surface layer 41 of the metallurgical composition 40 of the present invention. In the illustrated example, the structural substrate 30 and the two opposite surface layers of the metallurgical composition 40 are compacted in the interior of any adequate mold M, by two opposite punches P, forming a compacted and conformed composite product 1, which is posteriorly submitted to a sintering step. In this example, only the two opposite faces 31 of the structural substrate 30 will present the desirable self-lubricating properties.

Figure 4:
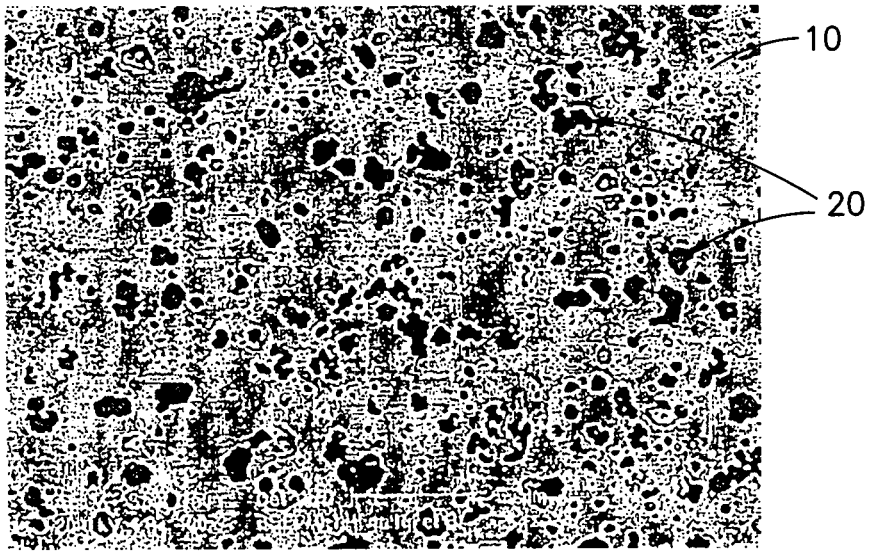
FIG. 4 represents a picture of the micro-structure of the self-lubricating sintered product whose structural matrix is a ferrous alloy, evidencing the graphite and hexagonal boron nitride particles and the provision of the liquid phase dispersed in the particulate material of the structural matrix during the sintering.
Figure 6C:
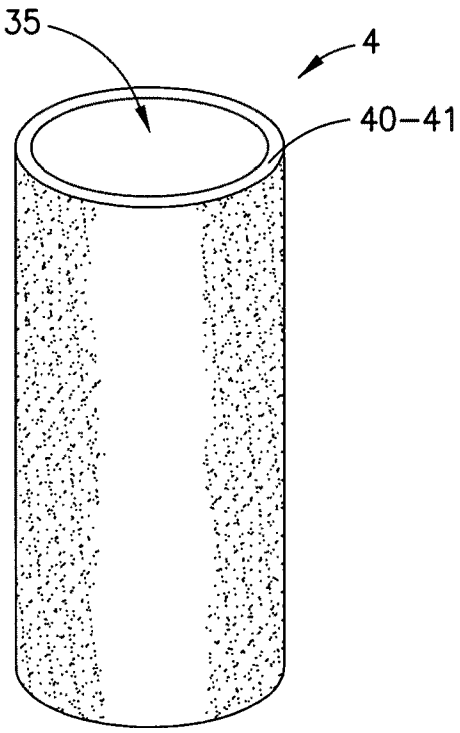
FIGS. 6A, 6B and 6C represent examples of products whose conformation is obtained by compaction carried out by extrusion, respectively, of a bar in a self-lubricating composite material, of a tube in a self-lubricating composite material, and of a bar with a core in metallic alloy coated with an outer layer of self-lubricating material.
Figure 6B:
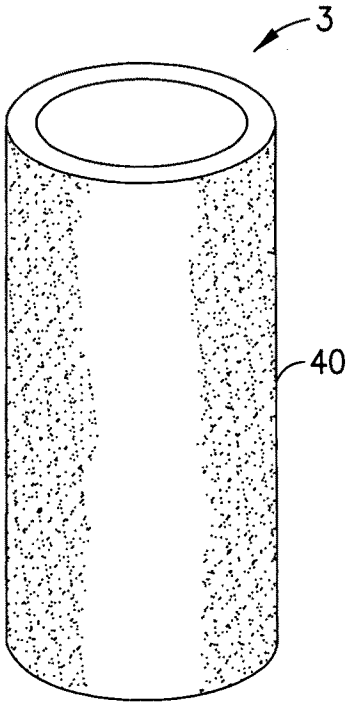
Figure 6A:
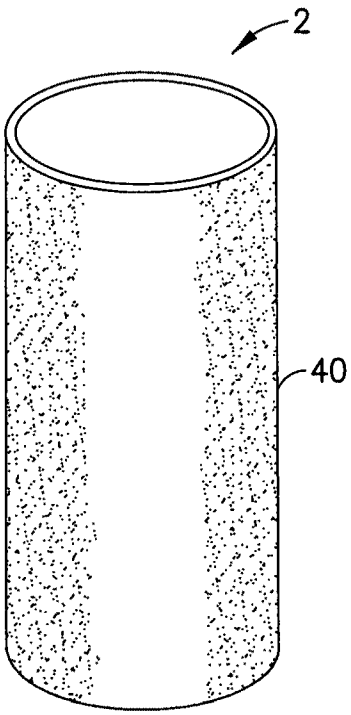

FIGS. 6A and 6B exemplify products in the form of a bar 2 and a tube 3, respectively, obtained by extrusion of the metallurgical composition 40 in an adequate extrusion matrix (not illustrated). In this case, the conformation by compaction of the metallurgical composition 40 is carried out in the extrusion step of the latter. The bar 2 or tube 3 can then be submitted to the sintering step, for the formation of the iron-based or nickel-based structural matrix 10 and incorporating dispersed discrete particles of the particulate solid lubricant 20, as schematically represented in FIGS. 3 and 4.

FIG. 6C illustrates another example of product formed by a composite bar 4, comprising a structural core 35, in a particulate material and which is circumferentially and externally surrounded by a surface layer 41 formed from the metallurgical composition 40 of the invention. Likewise in this case, the conformation and the compaction (densification) of the structural core 35 and the outer surface layer 41 in the metallurgical composition 40 are obtained by co-extrusion of the two parts of the composite bar 4, which is then submitted to the sintering step.

When the compaction of the metallurgical composition 20 is carried out by extrusion, as it occurs, for example, in the formation of the bars 2, 3 and 4 of FIGS. 6A, 6B and 6C, said composition can further comprise an organic binder which is thermally removed from the composition, after the conformation of the latter and before the sintering step, by any of the known techniques for said removal.

The organic binder may be, for example, any one selected from the group consisting of paraffin and other waxes, EVA, and low melting point polymers.

Figure 7:
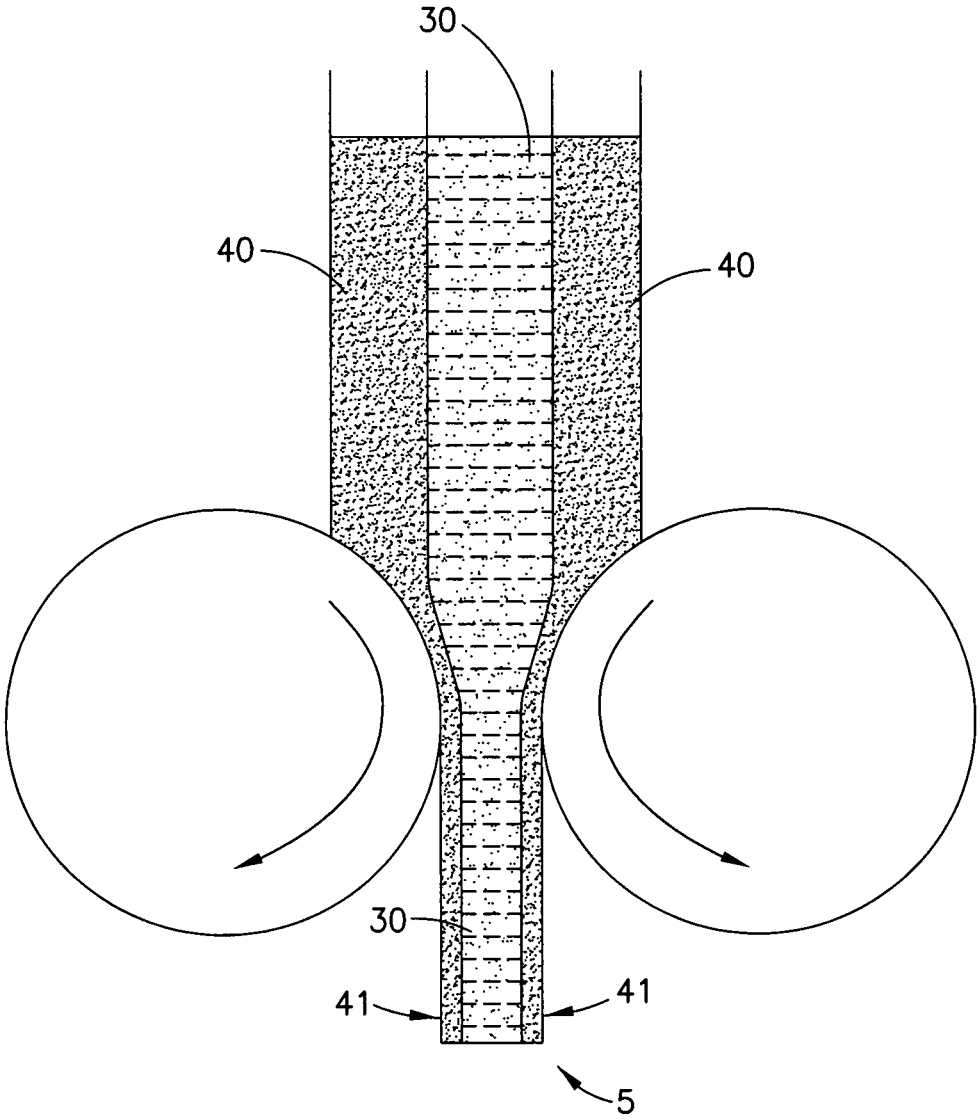
FIG. 7 schematically represents, in a simplified diagram, an example of compaction in the formation of a piece or product, to be posteriorly sintered, said compaction being made by rolling a self-lubricating composite material on the opposite faces of a plate or strip in metallic alloy.

FIG. 7 represents, also schematically, another way to obtain a sintered composite product, presenting one or more surface regions having self-lubricating characteristics. In this example, the product 5 to be obtained presents a structural substrate 30 formed in a particulate material, previously conformed in the form of a strip, it being noted that, on at least one of the opposite faces of the structural substrate 30, in the form of a continuous strip, is rolled a surface layer 41 of the metallurgical composition 40 of the present invention. The composite product 5 is then submitted to a sintering step.

While the invention has been presented herein by means of some examples of possible metallurgical compositions and associations with different structural substrates, it should be understood that such compositions and associations can suffer alterations that will become evident to those skilled in the art, without departing from the inventive concept of controlling the distribution, of the solid lubricant, in discrete particles, in the structural matrix, and of the eventual tendency of said solid lubricant to dissolve in said matrix, during the sintering step, as defined in the claims that accompany the present specification.

The invention claimed is:

1. A metallurgical composition of particulate materials, for forming conformed and sintered self-lubricating composite products, comprising:

a main particulate metallic material, in the form of a main chemical element, wherein the main particulate metallic material is iron, and at least one particulate hardening element, which form a structural matrix in the composite product to be sintered wherein the particulate hardening element has the function of hardening the structural matrix;

a non-metallic particulate solid lubricant, at least partially soluble in the structural matrix, wherein the particulate solid lubricant is a mixture consisting of graphite and hexagonal boron nitride;

an alloy component, with the function of stabilizing the iron alpha phase and of preventing the solubilization of the particulate solid lubricant in the iron; and at least one particulate alloy element capable of forming, during a sintering of a conformed metallurgical composition, a liquid phase between the main particulate metallic material which forms the structural matrix and the particulate solid lubricant, agglomerating the latter in discrete particles;

wherein the particulate solid lubricant represents a volumetric percentage lower than or equal to 15% of the volume of the composite material to be formed and the particulate hardening element, the particulate alloy element and the alloy component are silicon, at contents from 2% to 5% by weight of the metallurgical composition; and wherein said composition being conformed by compaction and characterized in that the main particulate metallic material of iron presents an average particle size lying between about 10 μm and about 90 μm, the hardening element with the function of hardening the structural matrix, and the particulate alloy element with the function of forming the liquid phase and agglomerating the particulate solid lubricant, during the sintering of the metallurgical composition conformed by compaction, presenting an average particle size smaller than about 45 μm.

2. A metallurgical composition of particulate materials, for forming conformed and sintered self-lubricating composite products, characterized in that it comprises:

a main particulate metallic material, in the form of a main chemical element, wherein the main particulate metallic material is nickel, and at least one particulate hardening element, which form a structural matrix in the composite product to be sintered;

a non-metallic, wherein a particulate solid lubricant is selected from graphite, hexagonal boron nitride or from a mixture of both in any proportion; and at least one particulate alloy element capable of forming, during the sintering of the conformed metallurgical composition, a liquid phase between the main particulate metallic material which forms the structural matrix and the particulate solid lubricant, agglomerating the particulate solid lubricant in discrete particles, wherein the particulate hardening element, with the junction of hardening the nickel matrix, and the particulate alloy element, with the function of forming the liquid phase and agglomerating the solid lubricant in discrete particles, are a mixture consisting of silicon, phosphorus and chrome, at contents from 2% to 8% by weight of the metallurgical composition.

3. The composition, as set forth in claim 2, conformed by compaction and characterized in that the main particulate metallic material of nickel presents an average particle size lying between 10 μm and 90 μm, the particulate hardening element, with the function of hardening the matrix, and the particulate alloy element, with the function of forming the liquid phase and agglomerating the particulate solid lubricant during the sintering of the metallurgical composition conformed by compaction, presenting an average particle size equal to or smaller than about 45 μm.

4. The composition, as set forth in claim 2, conformed by injection molding and characterized in that it further comprises an organic binder and that the main particulate metallic material of nickel, the hardening element, the particulate alloy element which forms the liquid phase, and the particulate solid lubricant present an average particle size lying between about 1 μm and about 45 μm.

5. A metallurgical composition of particulate materials, for forming conformed and sintered self-lubricating composite products, comprising:

a main particulate metallic material, in the form of a main chemical element, wherein the main particulate metallic material is iron, and at least one particulate hardening element, which form a structural matrix in the composite product to be sintered wherein the particulate hardening element has the function of hardening the structural matrix;

a non-metallic particulate solid lubricant, at least partially soluble in the structural matrix, wherein the particulate solid lubricant is a mixture consisting of graphite and hexagonal boron nitride;

an alloy component, with the function of stabilizing the iron alpha phase and of preventing the solubilization of the particulate solid lubricant in the iron; and at least one particulate alloy element capable of forming, during a sintering of a conformed metallurgical composition, a liquid phase between the main particulate metallic material which forms the structural matrix and the particulate solid lubricant, agglomerating the latter in discrete particles;

wherein the particulate solid lubricant represents a volumetric percentage lower than or equal to 15% of the volume of the composite material to be formed and the particulate hardening element, the particulate alloy element and the alloy component are silicon, at contents from 2% to 5% by weight of the metallurgical composition; and wherein the composition being conformed by injection molding and characterized in that it further comprises an organic binder and in that the main particulate metallic material of iron, the particulate hardening element, the particulate alloy element, which forms the liquid phase, and the particulate solid lubricant present an average particle size lying between about 1 μm and about 45 μm.

6. The composition, as set forth in claim 5, characterized in that the organic binder is selected from the group consisting of paraffin waxes and EVA waxes in a proportion ranging from about 40% to about 45% of the total volume of the metallurgical composition.

* * * * *